US005792735A

United States Patent [19]

Cook et al.

[11] Patent Number: 5,792,735

[45] Date of Patent: Aug. 11, 1998

[54] LUBRICATING OIL COMPOSITIONS

[75] Inventors: Stephen James Cook, North Humberside, England; Sean Patrick O'Connor, Ridgefield, Conn.; John Crawford, Surrey, England

[73] Assignee: BP Chemicals (Additives) Limited, London, England

[21] Appl. No.: 839,344

[22] Filed: Apr. 18, 1997

Related U.S. Application Data

[63] Continuation of Ser. No. 371,919, Jan. 11, 1995, abandoned.

[30] Foreign Application Priority Data

Jan. 11, 1994 [GB] United Kingdom ..... 9400417

[51] Int. Cl.[6] ..... C10M 159/22; C10M 159/20; C10M 159/24

[52] U.S. Cl. ..... 508/452; 508/398; 508/460

[58] Field of Search ..... 508/460, 452, 508/398

[56] References Cited

U.S. PATENT DOCUMENTS

| | | | |
|---|---|---|---|
| 3,652,410 | 3/1972 | Hollinghurst | 252/33 |
| 4,049,560 | 9/1977 | Dominey . | |
| 4,253,976 | 3/1981 | Forsberg | 252/39 |
| 4,328,111 | 5/1982 | Watson et al. | 252/33.4 |
| 4,842,755 | 6/1989 | Dunn | 252/42.7 |
| 4,954,273 | 9/1990 | Denis | 252/39 |
| 5,030,687 | 7/1991 | Leone . | |
| 5,069,804 | 12/1991 | Marsh et al. . | |

FOREIGN PATENT DOCUMENTS

| | | |
|---|---|---|
| 0 271 262 | 6/1988 | European Pat. Off. . |
| 0 273 588 | 7/1988 | European Pat. Off. . |
| 0 347 103 | 12/1989 | European Pat. Off. . |
| 476197A1 | 3/1992 | European Pat. Off. . |
| 0 558 021 A2 | 9/1993 | European Pat. Off. . |

*Primary Examiner*—Margaret Medley
*Attorney, Agent, or Firm*—Nixon & Vanderhye

[57] ABSTRACT

A lubricating oil composition suitable for use in low or medium speed diesel engines comprises a fuel oil with a residual oil content characterised in that the lubricating oil composition further comprises a hydrocarbyl-substituted phenate concentrate having a TBN greater than 300, and at least one of a hydrocarbyl-substituted salicylate and a hydrocarbyl-substitute sulphonate. The hydrocarbyl-substituted phenate is preferably one modified by incorporation of a carboxylic acid of the formula $RCH(R_1)CO_2H$ where R is a $C_{10}$–$C_{24}$ alkyl group and $R_1$ is hydrogen or a $C_1$ to $C_4$ alkyl group e.g. stearic acid.

9 Claims, No Drawings

LUBRICATING OIL COMPOSITIONS

This is a Rule 62 continuation of application Ser. No. 08/371,919, filed 11, Jan. 1995, now abandoned.

The present invention relates to lubricating oil compositions and in particular to lubricating oil compositions suitable for medium or low speed diesel engines, typically the four-stroke trunk-piston engine.

Lubricating oils for medium or low speed diesel engines are known and will typically contain a range of additives which will perform a variety of functions, for example they may comprise dispersants to minimise deposit formation in various parts of the engine or detergent additives. However contamination of these lubricating oil compositions with unburnt residual fuel oil is a problem recognised in the industry. This leads to severe engine cleanliness problems in service which is sometimes referred to as "black paint". The problem is particularly widespread in 4-stroke trunk-piston engines where dirty cam boxes and crankcases are encountered. However, the problem is not confined to 4-stroke engines. 2-stroke cross-head engines can also suffer from the problem. These 2-stroke engines will usually use two separate lubricating oils, one for the crankcase and one for the cylinder, but it is in the crankcase where the heavy deposits potentially occur.

Where the lubricating oil composition comprises a high TBN hydrocarbyl-substituted phenate, it has now been found that the problem of "black paint" is reduced by further incorporating into the lubricating oil composition a hydrocarbyl-substituted salicylate or a hydrocarbyl-substituted sulphonate.

Thus according to the present invention there is provided a lubricating oil composition suitable for use in low or medium speed diesel engines comprising a fuel oil with a residual oil content characterised in that the lubricating oil composition further comprises a hydrocarbyl-substituted phenate concentrate having a TBN greater than 300, and at least one of a hydrocarbyl-substituted salicylate and a hydrocarbyl-substituted sulphonate.

The lubricating oil composition of the present invention will be suitable for use in either a low or medium speed engine especially a marine diesel engine. Typically such an engine can be a 4-stroke trunk piston engine having an engine speed of 50–1,000 rpm e.g. 100–500 rpm, and a brake horse-power (BHP) per cylinder of 10–3,000 preferably 250–2,000. The engine can also be a 2-stroke cross-head engine having a speed of 40–1,000 rpm preferably 100–500 rpm and a brake horse-power per cylinder of 100–8,000.

In a further aspect of the present invention there is provided a method of reducing deposits in a low or medium speed diesel engine comprising lubricating the moving parts of the engine with a lubricating oil composition suitable for use in such an engine which comprises a fuel oil with a residual oil content characterised in that the lubricating oil composition further comprises a hydrocarbyl-substituted phenate concentrate having a TBN greater than 300, and at least one of a hydrocarbyl-substituted salicylate and a hydrocarbyl-substituted sulphonate.

The lubricating oil compositions of the present invention will have a TBN in the range 0.1 to 100 mgKOH/g. Where the composition is to be used in a 4-stroke trunk piston engine the TBN is preferably in the range 5–70, more preferably 8–50 mgKOH/g; where it is to be used in a 2-stroke cross-head engine and particularly for the crankcase, the TBN of the composition is preferably 0.1 to 15, more preferably 1 to 10 mgKOH/g.

The lubricating oil composition of the present invention will usually be a monograde lubricant i.e. one which exhibits little or no viscosity index improvement properties e.g. an SAE30 oil.

As regards the lubricating oil, this may be any oil suitable for the lubrication of a low or medium-speed diesel engine, particularly a marine diesel engine. The lubricating oil may suitably be an animal, a vegetable or a mineral oil. Suitably the lubricating oil is a petroleum-derived lubricating oil, such as a naphthenic base, paraffin base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example liquid polyisobutene and poly-alpha olefins. Commonly, a mineral oil is employed. The oil may be suitable for lubricating a low or medium speed marine diesel engine without adjustment of its viscosity. If viscosity adjustment is required it may be achieved by the addition of, for example, bright stock. The lubricating oil will generally comprise greater than 70% by weight, typically greater than 80% by weight of the composition.

The lubricating oil composition will be contaminated with a fuel oil which has a residual oil content. Such a fuel oil will be suitable for use as a diesel fuel oil. Fuel oils can in general be divided into two main categories—distillates and heavy fuels. Distillates consist of one or more distilled fractions. Heavy fuels are fuels which comprise at least a proportion of a residual oil, that is an oil which remains after the distilled fractions have been removed from an unrefined oil. The composition of the residual oil will vary with the composition of the starting oil which is usually a crude oil and will also vary depending upon the distillation conditions. However, by its nature residual oil is of high molecular weight and high boiling point and the man skilled in the art will know what is meant by residual oil. Heavy fuels can also comprise, in addition to residual oil, distillates. The present invention is concerned with lubricating oil compositions that are contaminated with a heavy fuel. The amount of heavy fuel in the lubricating oil composition will vary. Typically the composition will comprise between 0.1 to 10, e.g. 0.3 to 5, especially 0.5 to 3% by weight of heavy fuel.

The hydrocarbyl-substituted phenate concentrates of the present invention will have a TBN of greater than 300, preferably greater than 350, more preferably greater than 400, and will typically comprise a hydrocarbyl-substituted phenate, preferably an alkaline earth metal hydrocarbyl-substituted phenate, and lubricating oil. The amount of lubricating oil in the concentrate will be suitably in the range 10–90% by wt., preferably 10–70% by wt., more preferably 10–40% by wt. Where the phenate is an alkaline earth metal hydrocarbyl-substituted phenate, the alkaline earth metal is suitably calcium or magnesium, preferably calcium. The hydrocarbyl substituent or substituents of the hydrocarbyl-substituted phenate is preferably one or more alkyl groups. These may be branched or unbranched. Suitable alkyl groups contain from 4 to 50, preferably from 9 to 28 carbon atoms e.g. nonyl. A particularly suitable alkyl group is the $C_{12}$ group derivable from propylene tetramer. The hydrocarbyl-substituted phenate can be sulphurised or non-sulphurised, preferably sulphurised.

Particularly preferred hydrocarbyl-substituted phenates are those that have been modified by incorporation of a carboxylic acid having the formula $RCH(R_1)CO_2H$, where R is a $C_{10}$ to $C_{24}$ alkyl group and $R_1$ is hydrogen or a $C_1$ to $C_4$ alkyl group e.g. stearic acid. The amount of acid used to modify the hydrocarbyl-substituted phenate is preferably in the range 2 to 40, more preferably 10 to 35, for example 12 to 20%, by weight based upon the weight of concentrate comprising the hydrocarbyl-substituted phenate. Suitable carboxylic acid-modified, hydrocarbyl-substituted phenates are described in EP 271262 and EP 273588.

The hydrocarbyl-substituted phenate concentrate will be combined with at least one of a hydrocarbyl-substituted salicylate or a hydrocarbyl-substituted-sulphonate which may be in the form of a concentrate. The phenate concentrate can be combined with the salicylate or sulphonate prior to addition to the lubricating oil composition or they can be added separately. It is preferred to combine the phenate with the salicylate or sulphonate prior to addition.

The hydrocarbyl-substituted salicylate is preferably an alkaline-earth metal salicylate, more preferably a calcium hydrocarbyl-substituted salicylate. The hydrocarbyl-substituted salicylate can be sulphurised or non-sulphurised.

The hydrocarbyl substituent of the hydrocarbyl-substituted salicylate and their sulphurised derivatives may contain up to 125 aliphatic carbon atoms. Examples of suitable substituents include alkyl radicals, for example hexyl, cyclohexyl, octyl, isooctyl, decyl, tridecyl, hexadecyl, eicosyl and tricosyl, radicals derived from the polymerisation of both terminal and internal olefins, for example ethene, propene, 1-butene, isobutene, 1-hexene, 1-octene, 2-butene, 2-pentene, 3-pentene and 4-octene. Preferably the hydrocarbyl substituent is one derived from a monoolefin, more preferably from a monoolefin which is either propene, 1-butene or isobutene.

The hydrocarbyl-substituted sulphonate is preferably an alkaline-earth metal sulphonate, more preferably a calcium hydrocarbyl-substituted sulphonate. The hydrocarbyl substituted sulphonate may be prepared by any of the variety of means known in the art.

The hydrocarbyl substituent of the hydrocarbyl-substituted sulphonate may contain up to 125 aliphatic carbon atoms. Examples of suitable substituents include alkyl radicals, for example hexyl, cyclohexyl, octyl, isooctyl, decyl, tridecyl, hexadecyl, eicosyl and tricosyl, radicals derived from the polymerisation of both terminal and internal olefins, for example ethene, propene, 1-butene, isobutene, 1-hexene, 1-octene, 2-butene, 2-pentene, 3-pentene and 4-octene. Preferably the hydrocarbyl substituent is one derived from a monoolefin, more preferably from a monoolefin which is either propene, 1-butene or isobutene.

The hydrocarbyl-substituted salicylate and the hydrocarbyl-substituted sulphonate can optionally be modified by incorporation of a carboxylic acid of the formula R $CH(R_1)CO_2H$ as defined hereinabove.

The relative amount of hydrocarbyl-substituted phenate to hydrocarbyl-substituted salicylate or hydrocarbyl-substituted sulphonate is such that the contribution to the overall TBN of the lubricating oil composition of the phenate to that of the salicylate or sulphonate is in the range 10%:90% to 90%:10%, preferably 30%:70% to 70%:30%, for example 50%:50%.

In a further aspect of the present invention there is provided a lubricating oil additive concentrate comprising a hydrocarbyl-substituted phenate concentrate having a TBN greater than 300 and at least one of a hydrocarbyl-substituted salicylate and a hydrocarbyl-substituted sulphonate.

The amount of the mixture of hydrocarbyl-substituted phenate with hydrocarbyl-substituted salicylate or hydrocarbyl-substituted sulphonate in the final lubricating oil composition will be such as to give an overall TBN of 9 to 70 mg KOH/g preferably 15 to 40 for example 30 mg KOH/g.

In addition to the foregoing the composition may additionally contain additives conventionally employed in low or medium speed diesel engine lubricating oil compositions. Examples of such additives include detergents, foam inhibitors, extreme pressure/antiwear agents, rust inhibitors, antioxidants, and the like. Alternatively, the concentrates comprising a hydrocarbyl substituted phenate concentrate having a TBN greater than 300 with or without a hydrocarbyl-substituted salicylate or a hydrocarbyl-substituted sulphonate can be combined with other additive concentrates or additives referred to hereinabove to produce a lubricating oil additive package.

The composition of the invention may be prepared by diluting a concentrate comprising hydrocarbyl-substituted phenate concentrate having a TBN greater than 300, and at least one of a hydrocarbyl-substituted salicylate and a hydrocarbyl-substituted sulphonate and optionally the other additives referred to hereinbefore. Alternatively, a lubricating oil additive package may be added directly to a lubricating oil to produce a lubricating oil composition of the present invention.

The invention will now be further illustrated by reference to the following examples. In the examples the total sediment content of residual fuel contaminated compounded oils is determined.

In the test method, ten grams of the test oil which has previously been subjected to ageing at 100° C. for 24 hr is filtered through a filter medium. After solvent washing and drying the total sediment on the filter medium is weighed. The test oil used was an SAE50 grade lube oil contaminated with 20% residual fuel oil having a high asphaltene content. The test is carried out in duplicate.

Results

The mass percentage of Total Sediment to the nearest 0.01% m/m is calculated using:

$$S = \frac{M1 - M2}{M3} \times 100$$

where

S=Total Sediment in % m/m

M1=Mass of filter medium after filtration in g

M2=Mass of filter medium before filtration in g

M3=Mass of sample filtered in g.

EXAMPLE 1

ADX 410 (a 400 TBN hydrocarbyl-substituted phenate available from Adibis) and SAP 002 (a 60 TBN hydrocarbyl-substituted salicylate) were mixed in varying proportions and the mixture used to bring the TBN of the test fuel oil to 30 mg KOH/g. The sediment levels were then measured by the Adibis Test Method for black paint. The results are then compared with the expected sediment levels calculated assuming a linear relationship from 100% ADX 410 to 100% SAP 002. The results are given in Table 1.

TABLE 1

| | Sediment % | |
|---|---|---|
| ADX 410:SAP 002 | Actual | Expected |
| 100:0 | 0.085 | 0.085 |
| 75:25 | 0.063 | 0.088 |
| 50:50 | 0.075 | 0.092 |

TABLE 1-continued

| ADX 410:SAP 002 | Sediment % Actual | Expected |
|---|---|---|
| 25:75 | 0.081 | 0.095 |
| 0:100 | 0.098 | 0.098 |

EXAMPLE 2

Example 1 was repeated except that SAP 005 (a 280 TBN hydrocarbyl-substituted salicylate available from Shell) was used instead of SAP 002. The results are given in Table 2.

TABLE 2

| ADX 410:SAP005 | Sediment (%) Actual | Expected |
|---|---|---|
| 100:0 | 0.085 | 0.085 |
| 75:25 | 0.073 | 0.092 |
| 50:50 | 0.064 | 0.100 |
| 25:75 | 0.085 | 0.107 |
| 0:100 | 0.114 | 0.114 |

EXAMPLE 3

Example 1 was repeated except that Hitec 611 (a 300 TBN hydrocarbyl-substituted sulphonate available from Ethyl Corporation) was used instead of SAP 002. The results are given in Table 3. The fuel oil used in Example 3 was different to that used in Example 1 and 2 (which were the same).

TABLE 3

| ADX 410:Hitec 611 | Sediment (%) Actual | Expected |
|---|---|---|
| 100:0 | 0.172 | 0.172 |
| 75:25 | 0.184 | 0.476 |
| 50:50 | 0.238 | 0.779 |
| 25:75 | 0.987 | 1.082 |
| 10:90 | 1.139 | 1.264 |
| 0:100 | 1.385 | 1.385 |

We claim:

1. A method of reducing deposits in a low or medium speed two-stroke or four-stroke diesel engine which causes contamination of lubricating oil with a heavy fuel having a residual oil content, said method comprising lubricating the moving parts of the engine with a lubricating oil composition comprising:

a low or medium speed two-stroke or four stroke diesel lubricating oil contaminated with a heavy fuel having a residual oil content, a concentrate comprising a hydrocarbyl-substituted phenate modified by incorporation of a carboxylic acid having the formula $RCH(R_1)CO_2H$ where R is a $C_{10}$–$C_{24}$ alkyl group and $R_1$ is hydrogen or a $C_1$ to $C_4$ alkyl group and having a TBN of greater than 300, and a hydrocarbyl-substituted salicylate, the relative amount of said hydrocarbyl-substituted phenate to hydrocarbyl-substituted salicylate being such that the contribution of the overall TBN of lubricating oil composition of the phenate to that of the salicylate is in the range of 10%:90% to 90%:10%, said composition exhibiting reduced deposit formation from unburnt residual fuel oil.

2. A method according to claim 1, wherein the hydrocarbyl-substituted phenate concentrate has a TBN greater than 400.

3. A method according to claim 1, wherein the carboxylic acid is present in an amount in the range 2 to 40% by weight based upon the weight of the hydrocarbyl-substituted phenate concentrate.

4. A method according to claim 1, wherein the carboxylic acid is stearic acid.

5. A method according to claim 1, wherein the lubricating oil composition is a monograde lubricant.

6. A method according to claim 1, wherein the composition is suitable for use in a 4-stroke trunk piston engine and has a TBN in the range 5–70 mgKOH/g.

7. A method according to claim 1, wherein the composition is suitable for use in a 2-stroke cross-head engine and has a TBN in the range 1–10 mgKOH/g.

8. A method according to claim 1, wherein the composition comprises between 0.5 to 3% by weight of heavy fuel.

9. A method of reducing deposits in a low or medium speed two-stroke or four-stroke diesel engine which causes contamination of lubricating oil with a heavy fuel having a residual oil content, said method, comprising lubricating the moving parts of the engine with a lubricating oil composition comprising:

a low or medium speed two-stroke or four stroke diesel lubricating oil contaminated with a heavy fuel having a residual oil content, a concentrate comprising a hydrocarbyl-substituted phenate modified by incorporation of a carboxylic acid having the formula $RCH(R_1)CO_2H$ where R is a $C_{10}$–$C_{24}$ alkyl group and $R_1$ is hydrogen or a $C_1$ to $C_4$ alkyl group and having a TBN greater than 300, and a hydrocarbyl-substituted sulphonate, the relative amount of said hydrocarbyl-substituted phenate to hydrocarbyl-substituted sulphonate being such that the contribution of the overall TBN of lubricating oil composition of the phenate is 75% or greater and the contribution of the overall TBN of lubricating oil composition of the sulphonate is 25% or less, said composition exhibiting reduced deposit formation from unburnt residual fuel oil.

* * * * *